US010171898B2

(12) United States Patent
Lee

(10) Patent No.: US 10,171,898 B2
(45) Date of Patent: Jan. 1, 2019

(54) CUP

(71) Applicant: ATake Digital Technology (Shenzhen) Co., Ltd., Shenzhen (CN)

(72) Inventor: Kuo-Tsai Lee, Taipei (TW)

(73) Assignee: ATAKE DIGITAL TECHNOLOGY (SHENZHEN) CO., LTD., Shenzhen (CN)

( * ) Notice: Subject to any disclaimer, the term of this patent is extended or adjusted under 35 U.S.C. 154(b) by 35 days.

(21) Appl. No.: 15/392,363

(22) Filed: Dec. 28, 2016

(65) Prior Publication Data

US 2018/0152776 A1 May 31, 2018

(30) Foreign Application Priority Data

Nov. 30, 2016 (CN) ..... 2016 1 1089620

(51) Int. Cl.
*H04R 1/02* (2006.01)
*B65D 25/28* (2006.01)
(Continued)

(52) U.S. Cl.
CPC ..... *H04R 1/028* (2013.01); *B65D 25/2802* (2013.01); *B65D 25/54* (2013.01); *B65D 43/0225* (2013.01); *F21V 33/0036* (2013.01); *F21V 33/0056* (2013.01); *B65D 51/248* (2013.01); *B65D 2203/12* (2013.01); *B65D 2525/283* (2013.01); *F21V 23/003* (2013.01); *F21Y 2115/10* (2016.08)

(58) Field of Classification Search
CPC .... H04R 1/028; B65D 25/2802; B65D 25/54; B65D 43/0225; B65D 51/248; B65D 2525/283; F21V 23/003; F21V 33/0036; F21V 33/0056; F21Y 2115/10
USPC ..... 381/334
See application file for complete search history.

(56) References Cited

U.S. PATENT DOCUMENTS

2003/0089713 A1* 5/2003 Belt ..... B65D 47/265 220/253
2013/0292381 A1* 11/2013 Chen ..... B65D 43/0212 220/254.4
2017/0071376 A1* 3/2017 VandenLangenberg ..... A47G 19/2227

FOREIGN PATENT DOCUMENTS

CN 201143009 * 12/2007
CN 202408214 U 9/2012
(Continued)

OTHER PUBLICATIONS

Office Action of CN201611089620.2 dated Jul. 4, 2017.
Office Action of CN201611089620.2 dated Jan. 17, 2018.

*Primary Examiner* — Quynh H Nguyen
(74) *Attorney, Agent, or Firm* — Wayne & King LLC

(57) ABSTRACT

The present disclosure provides a cup, which includes a cup body, a top part of the cup body has a rim; a cup lid, the cup lid has a bottom cover and a top cover connected with a top end of the bottom cover, and a bottom end of the bottom cover is connected with the rim, the top cover is fixed with the top end of the bottom cover through a rotary clamping structure, and the bottom cover and the top cover cooperatively form a sealed mounting cavity; and an audio broadcast device, the audio broadcast device is assembled in the mounting cavity. The disassembly and assembly processes of the top cover and the bottom cover are simple, it is much more convenience to assemble the rotary clamping structure in the mounting cavity or disassemble the rotary clamping structure from the rotary clamping structure.

10 Claims, 4 Drawing Sheets

(51) Int. Cl.

| | |
|---|---|
| ***B65D 25/54*** | (2006.01) |
| ***B65D 43/02*** | (2006.01) |
| ***B65D 51/24*** | (2006.01) |
| ***F21V 23/00*** | (2015.01) |
| ***F21V 33/00*** | (2006.01) |
| ***F21Y 115/10*** | (2016.01) |

(56) References Cited

FOREIGN PATENT DOCUMENTS

| | | |
|---|---|---|
| CN | 203436092 U | 2/2014 |
| CN | 203662450 U | 6/2014 |

* cited by examiner

CUP

CROSS-REFERENCE TO RELATED APPLICATIONS

This application claims priority benefit of Chinese Patent Application No. 201611089620.2 with a filing date of Nov. 30, 2016. The content of the aforementioned application, including any intervening amendments thereto, are incorporated herein by reference.

TECHNICAL FIELD

The present disclosure relates to the field of cup technologies.

BACKGROUND OF THE PRESENT INVENTION

Cup is a kind of indispensable article for daily use, in order to meet people's need, the traditional cup not only has the function of filling water, but also realizes music broadcast function by locating audio broadcast device in the cup. Mounting audio broadcast device in the cup has a strict demand for processing, the most common way is setting a sealed mounting cavity on the cup lid of the cup, and the audio broadcast device is mounted in the mounting cavity. However, the traditional mounting method normally adopts integrated cup lid, which will cause that the cup lid cannot be opened to repair the audio broadcast device when the audio broadcast device does not work, it leads to lots of inconvenience.

SUMMARY OF PRESENT INVENTION

The main aim of the present disclosure is providing a cup, which aims to improve the assembly mode of the audio broadcast device inside the cup, so that the assembly and disassembly processes of the audio broadcast device are simple and convenience.

In order to achieve the above aim, the cup of the present disclosure includes a cup body, a top part of the cup body includes a rim; a cup lid, the cup lid includes a bottom cover and a top cover connected with a top end of the bottom cover, and a bottom end of the bottom cover connected with the rim, the top cover is fixed with the top end of the bottom cover through a rotary clamping structure, and the bottom cover and the top cover cooperatively form a sealed mounting cavity; and an audio broadcast device, the audio broadcast device is assembled in the mounting cavity.

Preferably, the rotary clamping structure includes a clamping block located at the bottom cover, and a sliding rail located at the top cover, the sliding rail includes an importing part formed along an axial direction of the top cover and a clamping groove part formed along a periphery direction of the top cover.

Preferably, the clamping block is located at an inside surface of the bottom cover, the sliding rail is located at an outside surface of the top cover.

Preferably, a limiting structure including a protrude and a groove is located between the clamping groove part and the clamping block.

Preferably, the importing part gradually expands from top to bottom.

Preferably, a light emitting source is located inside the cup body, the cup body is transparent or translucent, or the cup body has a transparent or translucent observing window.

Preferably, a controlling module is located in the mounting cavity, the controlling module is electrically connected with the audio broadcast device and the light emitting source, for that the light emitting source blinks following the audio broadcast by the audio broadcast device.

Preferably, an outer wall of the bottom cover is concavely provided with an annular groove, at least one controlling key electrically connected with the controlling module is located inside the annular groove.

Preferably, a top surface of the top cover has a handle, the handle includes a buckling part and an mounting part spaced with the buckling part, a pressing buckle located between the mounting part and the buckling part.

Preferably, a bottom of the cup body has a detachable base, the detachable base is made of wear-resistant material.

The cup of the present disclosure mounts the audio broadcast device in the mounting cavity cooperatively formed by the top cover and the bottom cover, and, the top cover is fixed with the bottom cover through a rotary clamping mode, that, is: the rotary clamping structure includes the clamping block located at the bottom cover, and the sliding rail located at the top cover, the clamping block corresponds to the sliding rail, the rotary clamping structure can enable the assemble and disassemble processes of the top cover and the bottom much easier, furthermore, it is much more convenience to assemble the rotary clamping structure in the mounting cavity or disassemble the rotary clamping structure from the rotary clamping structure.

DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only about some embodiments of the present invention, and persons of ordinary skill in the art can derive other drawings from the accompanying drawings without creative efforts.

LABELS ILLUSTRATION FOR DRAWINGS

TABLE 1

| Label | Name |
|---|---|
| 100 | first cup body |
| 200 | second cup body |
| 300 | cup lid |
| 400 | audio broadcast device |
| 500 | light emitting source |
| 600 | controlling module |
| 210 | base |
| 310 | bottom over |
| 320 | top cover |
| 510 | lampshade |
| 520 | lamp panel |
| 311 | damping block |

TABLE 1-continued

| Label | Name |
|---|---|
| 312 | controlling key |
| 313 | silicone ring |
| 314 | sealing cover |
| 321 | sliding rail |
| 322 | handle |
| 321a | importing part |
| 321b | clamping groove part |
| 322a | bucklingpart |
| 322b | mounting part |
| 322c | pressingbuckle |
| 510a | fixing part |

The realizing of the aim, functional characteristics, advantages of the present disclosure are further described in detail with reference to the accompanying drawings and the embodiments.

DETAILED DESCRIPTION OF PREFERRED EMBODIMENTS

The technical solutions of the embodiments of the present disclosure will be clearly and completely described in the following with reference to the accompanying drawings. It is obvious that the embodiments to be described are only a part rather than all of the embodiments of the present invention. All other embodiments obtained by persons skilled in the art based on the embodiments of the present invention without creative efforts shall fall within the protection scope of the present invention.

It is to be understood that, all the directional instructions of in the present disclosure (such as top, down, left, right, front, back . . . ) can only be used for explaining relative position relations, moving condition of the elements under a special form (referring to figures), and so on, if the special form changes, the directional instructions changes accordingly.

In addition, the descriptions, such as the "first", the "second" in the present disclosure, can only be used for describing the aim of description, and cannot be understood as indicating or suggesting relative importance or impliedly indicating the number of the indicated technical character. Therefore, the character indicated by the "first", the "second" can express or impliedly include at least one character. In addition, the technical proposal of each exemplary embodiment can be combined with each other, however the technical proposal must base on that the ordinary skill in that art can realize the technical proposal, when the combination of the technical proposals occurs contradiction or cannot realize, it should consider that the combination of the technical proposals does not existed, and is not contained in the protection scope required by the present disclosure.

The present disclosure provides a cup, the cup designs the cup lid to have a rotary clamping structure, so that the cup lid can be easily opened, for repairing the audio broadcast device located in the cup lid.

Figure 1:
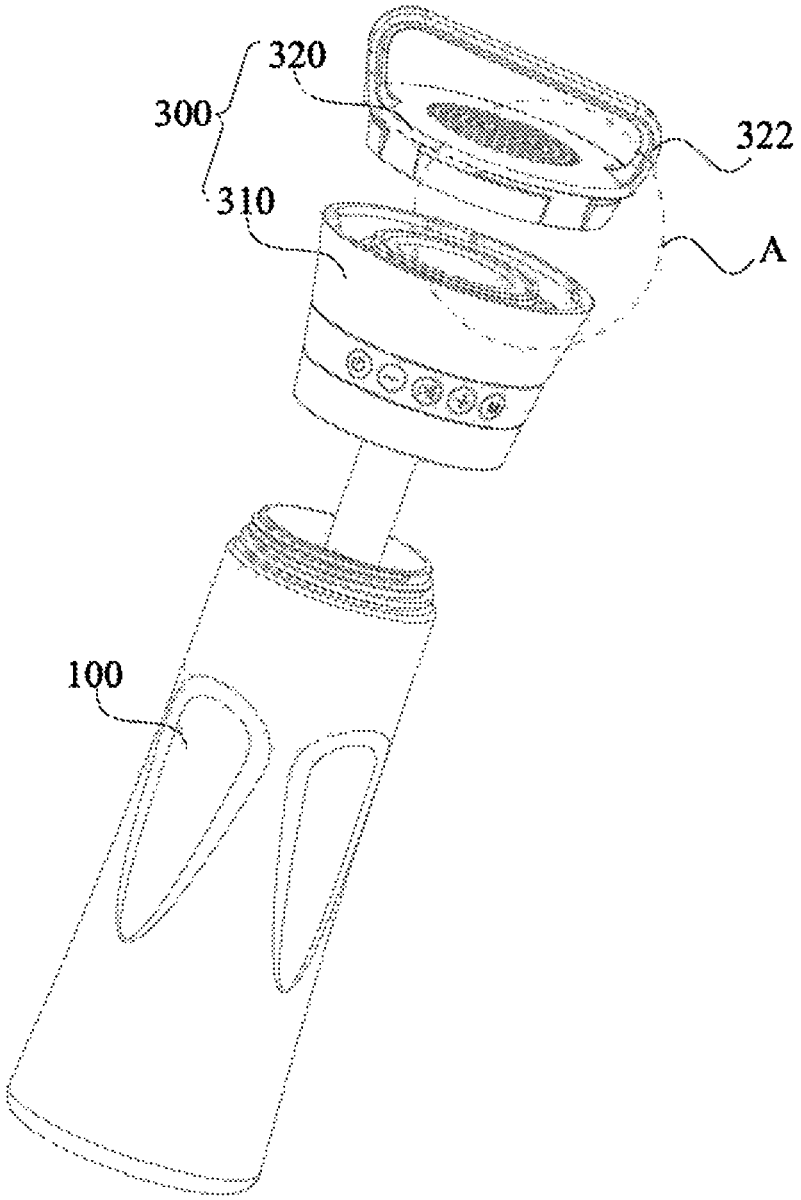
FIG. 1 is an exploded structure diagram of a cup provided by a first exemplary embodiment of the present disclosure.
Figure 2:
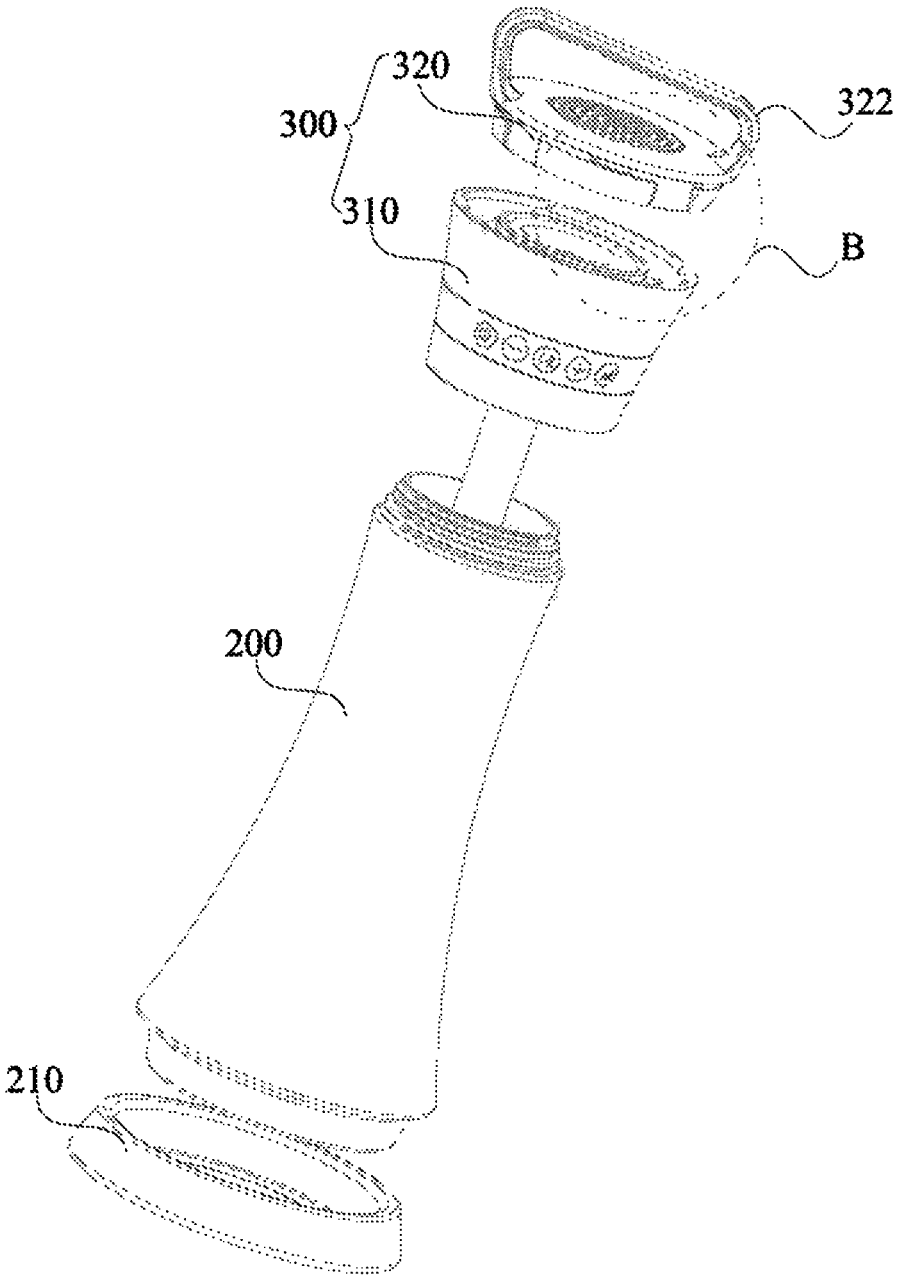
FIG. 2 is an exploded structure diagram of a cup provided by a second exemplary embodiment of the present disclosure.

Referring to FIGS. 1-2, the cup of the present disclosure includes: a cup body, a cup lid 300 and an audio broadcast device 400 assembled inside the cup lid 300. And, the present disclosure provides two kind of cup bodies, which respectively include a first cup body 100 shown in FIG. 1 and a second cup body shown in FIG. 2, besides the cup bodies, other structures of two cups are the same, now the technical conception of the present disclosure can be illustrated according to the cup having the first cup body 100. A top part of the cup body 100 has a rim, a lateral surface of the rim has external thread; the cup lid 300 includes a bottom cover 310 connected with the external thread of the rim, and a top cover 320 connected with a top end of the bottom cover 310, the top cover 320 is fixed with the bottom cover 310 through a rotary clamping structure, the bottom cover 310 is clamped with the top cover 320 for forming a sealed mounting cavity, the audio broadcast device 400 is bled inside the mounting cavity. In detail, the bottom cover 310 is cylinder shaped, and has a hollow structure, the bottom part of the bottom cover 310 has a separative plate, an internal wall of the bottom cover 310 below the separative plate has internal thread which is threaded with the external thread of the cup body, the separative plate and the top cover 320 cooperatively form the sealed mounting cavity. As the mounting cavity is separated from the fluid contained in the cup body from the separative plate, so the audio broadcast device mounted in the mounting cavity would not be filled with water or steam, the using time of the audio broadcast device would not decrease.

Now the using process of the present disclosure is further illustrated, when mounting the audio broadcast device 400 or the audio broadcast device 400 does not work, it is need to disassemble the cup lid 300 for taking out the audio broadcast device 400 for repairing, as the top cover 320 is fixed with the bottom cover 310 through the rotary clamping structure, so the top cover 320 can be separated from the bottom cover 310 by rotating the top cover 320, for mounting or repairing the audio broadcast device 400. It is convenience to assemble or disassemble through the audio broadcast device, it is stably, so when the audio broadcast device 400 does not work, user can easily separate the top cover 320 from the bottom cover 310 for repairing the audio broadcast device mounted in the mounting cavity.

Figure 3:
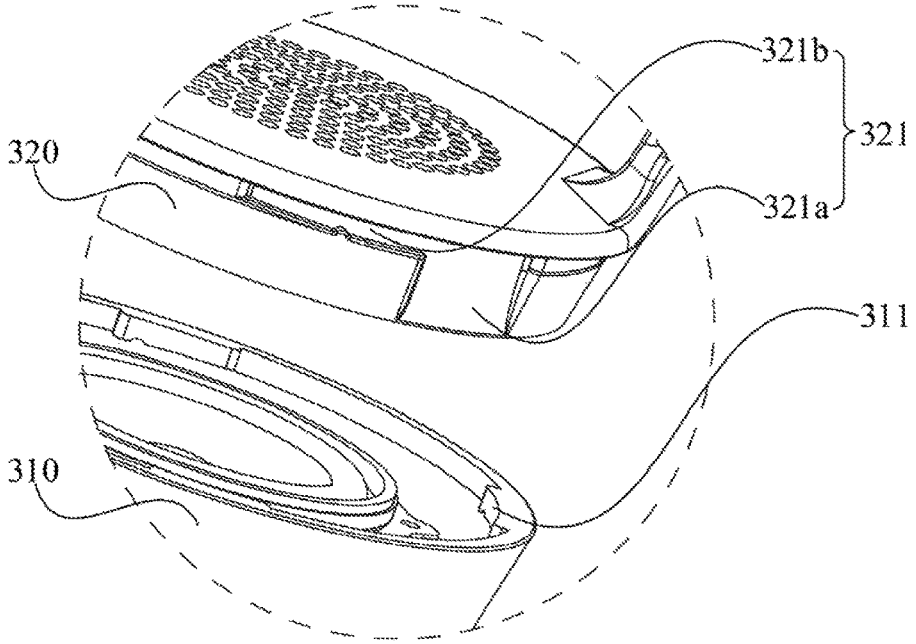
FIG. 3 is an enlarge diagram of A shown in FIG. 1 or B shown in FIG. 2.

In an exemplary embodiment, referring to FIG. 3, the rotary clamping structure includes a clamping block 311 located at the bottom cover 310, and a sliding rail 321 located at the top cover 320, the sliding rail 321 includes an importing part 321*a* formed along an axial direction of the top cover 320 and a clamping groove part 321*b* formed along a periphery direction of the top cover 320. In detail, in order to improve the stability of the rotary clamping structure, the rotary clamping structure has a plurality of clamping blocks 311, the clamping blocks 311 are spaced from each other and located at the inner surface of the edge of the bottom cover 310, the sliding rail 321 corresponds to the clamping blocks 311 and located at the outside surface of the edge the top cover 320. In another exemplary embodiment, positions of the clamping block and the sliding rail can be exchanged, that is, the clamping block can be located at the outside surface of the top cover, and the sliding rail can be located at the inside surface of the bottom cover.

The assemble and disassemble process of the rotary clamping structure can be further illustrated according to FIG. 3, when user need to separate the top cover 320 of the cup lid 300 from the bottom cover 310, for repairing the audio broadcast device 400 in the mounting cavity, it is only need to rotary the top cover 320 along the periphery direction of the top cover 320 corresponding to the bottom cover 310, so that the clamping block 311 slides into the importing part 321*a* along the clamping groove part 321*b* of the sliding rail 321, at this time, the clamping block 311 can be separated from the sliding rail 321 by raising the top cover 320 along the axis direction of the cup lid 300, so that the top cover 320 is separated from the bottom cover 310, and the audio broadcast device 400 mounted in the mounting cavity can be repaired, it is much more convenience to assemble the clamping block 311 with the sliding rail 321 or disassemble the clamping block 311 from the sliding rail 321, the efficiency of assemble or disassemble the cup lid 300, and further assemble or disassemble the audio broadcast device 400 and improved.

In another exemplary embodiment, the rotary clamping structure can also be rotary clamping structure having fixing lug and a fixing clamping groove, in detail, the fixing clamping groove is located at the inner edge of the bottom cover, the opening direction of the fixing clamping groove corresponds to the rotary direction of the top cover; the fixing lug is located at the external wall of the bottom cover, the thickness of the fixing lug corresponds to the size of the fixing clamping groove, so that the fixing lug can rotate into the fixing clamping groove and rotatably clamped with the fixing clamping groove.

In the exemplary embodiment of the present disclosure, referring to FIG. 3, in order to making the clamping block 311 easily enter into the importing part 321*a*, the importing part 321*a* gradually expands from top to bottom. As the opening of the importing part 321*a* gradually expands from top to bottom, so the length of the bottom of the importing part 321*a* is larger than the length of the clamping block 311, so that the clamping block 311 can easier match with the importing part 321*a* and enter into the importing part 321*a*, so that it is much more convenience the rotary clamping between the bottom cover 310 and the top cover 320.

In another exemplary embodiment, referring to FIG. 2, in order to prevent the top cover 320 can be easily separated from the bottom cover 310 after the top cover 320 is mounted with the bottom cover 310, a limiting structure including a protrude and a groove is located between the clamping groove part 321*b* and the clamping block 311. In detail, the protrude is located at the clamping groove part 321*b*, the groove is located at the bottom of the clamping block 311, and in order to make the clamping block 311 rotationally clamped with the sliding rail 321 the protrude has curved surface, the shape of the groove correspond with the protrude, so, when the clamping block is clamped with the sliding rail 321, the protrude is clamped in the groove, at this time, the protrude and the groove can further enforce the fixing of the top cover 320 with the bottom cover 310; when it is need to separate the top cover 320 from the bottom cover 310, the stress of the groove and the protrude having curved surface reach to a certain value, the top cover 320 can also be easily separated from the bottom cover 310.

In another exemplary embodiment, referring to FIG. 4M a light source 500 is assembled in the first cup body 100, the cup body is transparent or translucence, in the exemplary embodiment, the light source 500 can be a LED lamp, the LED lamp can include: lampshade 510, the top of the lampshade 510 has a fixing part 510*a*, a lamp panel 520 is assembled in the lampshade 510, a mounting plate assembled in the bottom cover 310, a center of the mounting plate has a mounting hole, the LED lamp can pass through the mounting hole, a peripheral of the mounting hole corresponding to the fixing part 510*a* of the lampshade 510 has a round of ultrasonic weld line, the lampshade 510 is fixed with the bottom cover 310 through ultrasonic welding process, and the LED lamp is fixed under the cup lid 300, so that the light emitting part of the LED lamp is assembled in the first cup body 100. As the LED lamp is assembled in the first cup body 100, and connected with the fluid contained in the first cup body 100, so the lampshade 100 should exhibit excellent thermostability, non-toxic, harmless, and is well sealed and transmittance, in the exemplary embodiment, the lampshade 510 is made of copolymer polyester material.

Light emitted from the light source 500 can pass through the first cup body 100 and scatter outward, for forming bright and colorful lighting effect. Preferably, in another exemplary embodiment, a controlling module 600 is assembled in the mounting cavity 600, the controlling module 600 can be PCB plate, the controlling module 600 is electrically connected with the audio broadcast device 400 and the light source 500, so that the light source 500 can spangle following the frequency of the audio broadcast device 400, so that the cup has dynamic, changeable lighting effect.

Figure 4:
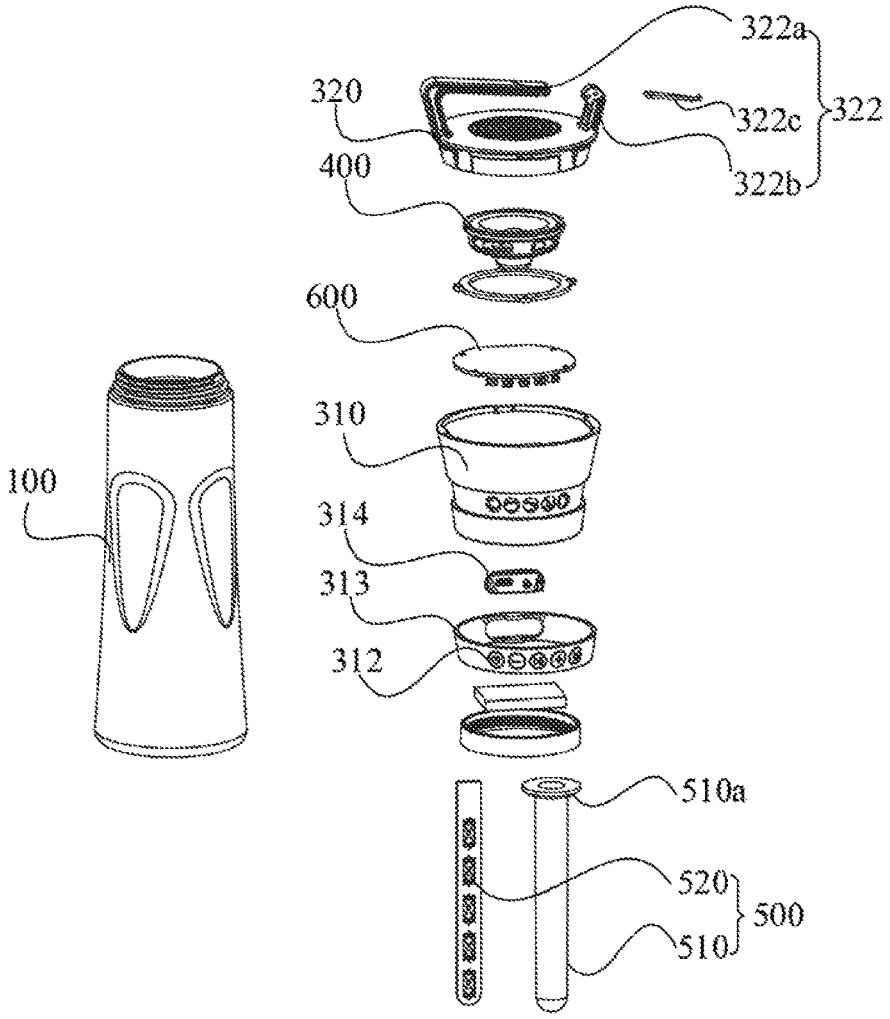
FIG. 4 is an exploded structure diagram of a cup provided by a third exemplary embodiment of the present disclosure.

In the exemplary embodiment, referring to FIG. 4, the external wall of the bottom cover 310 is concavely provided with an annular groove, at least one controlling key 312 electrically connected with the controlling module is located inside the annular groove, a silicone ring 313 is located between the controlling key 312 and the bottom cover 310, the silicone ring 313 is closely matched with the controlling key 312 and the annular groove of the bottom cover 310, so that the controlling key located on the bottom cover 310 is water-proof, dust-proof, so that the using time of the controlling key 312 is improved. In addition, a charging interface is also located at the PCB plate, the silicone ring 313 has a slot corresponding to the charging interface, a sealing cover 314 is detachably set in the slot, the sealing cover 314 can cover the slot, for preventing water or dust entering into the charging interface.

Two kinds of the cup body structures can be illustrated according to FIG. 1 and FIG. 2, the cup body has two structures, which includes the first cup body 100 shown in FIG. 1 (an abbreviation of the first cup body structure) and the second cup body 200 shown in FIG. 2 (an abbreviation of the second cup body structure). And, the lateral surface of the first cup body 100 has a teardrop-shaped groove, on one side, the groove can improve of the friction when user holds the cup, on the other hand, when the LED lamp in the first cup body 100 emits light, the groove of the first cup body 100 can make the light change to be much gorgeous; the cup wall of the second cup body 200 is hyperbolic set, and the bottom of the second cup body 200 has a base 210 which can be clamped with the second cup body 200, the base is made of wear-resistant material, such as: ABS plastic, ceramics, stainless steel and so on, the above materials all have high wear resistance, so that the abrasion of the base 210 is reduced. The other parts of the first cup body 100 and the second cup body 200 can be made of copolymer polyester material, the copolymer polyester material is clear and transparent, and can withstand high heat, is non-toxic and harmless under high temperature, can not only ensure the human body health, but also ensure that light from the LED lamp has enough transmissivity, easy to think that the first cup body 100 and the second cup body 208 can be made of other material which is transparent and nontoxic, such as glass and so on.

Referring to FIGS. 1-2, the structure of the general handle 322 is shown in FIG. 1 and FIG. 2, in order to convenience the hanging of the cup, the present disclosure modifies the handle 322 of the cup to have the structure shown in FIG. 4, in detail, the modified handle 322 includes buckling part 322*a*, and mounting part 322*b* spaced with the buckling part 322*a*, a pressing buckle 322*c* is located between the mounting part 322*b* and the buckling part 322*a*. The pressing buckle 322*c* has a torsional spring structure, one end of the pressing buckle 322*c* is hinged with the mounting part 322*b*, the other end of the pressing buckle 322*c* resists with a bottom end of the buckling part 322*a* closing to a side of the mounting part 322*b*, user presses down the pressing buckle

322*c*, the handle 322 can be hanged to a needed position, such that, climbers or travelers can hanger the cup provided by the present disclosure on the bag, and the use of the cup is convenience.

The embodiments above are preferably embodiments of the present disclosure, and the present disclosure is not limited to such embodiments, equivalent structure conversion based on the specification and the drawing of the present disclosure, or directly or indirectly used in other related technical field, both similarly within the protection scope of the present disclosure.

I claim:

1. A cup, which comprising:

a cup body, a top part of the cup body comprising a rim, a cup lid, the cup lid comprising a bottom cover and a top cover connected with a top end of the bottom cover, and a bottom end of the bottom cover being connected with the rim, the top cover being fixed with the top end of the bottom cover through a rotary clamping structure, the rotary clamping structure comprising a clamping block located at the bottom cover, and a sliding rail located at the top cover, the sliding rail comprising an importing part formed along an axial direction of the top cover and a clamping groove part formed along a periphery direction of the top cover, the clamping block being configured to slide into the importing part along the clamping groove part of the sliding rail, and the bottom cover and the top cover cooperatively forming a sealed mounting cavity; and an audio broadcast device, the audio broadcast device being assembled in the mounting cavity.

2. The cup according to claim 1, wherein the clamping block is located at an inside surface of the bottom cover, the sliding rail is located at an outside surface of the top cover.

3. The cup according to claim 1, wherein a limiting structure comprising a protrude and a groove is located between the clamping groove part and the clamping block.

4. The cup according to claim 1, wherein the importing part gradually expands from top to bottom.

5. The cup according to claim 1, wherein a light emitting source is located inside the cup body, the cup body is transparent or translucent, or the cup body has a transparent or translucent observing window.

6. The cup according to claim 5, wherein a controlling module is located in the mounting cavity, the controlling module is electrically connected with the audio broadcast device and the light emitting source, for that the light emitting source blinks following the audio broadcast by the audio broadcast device.

7. The cup according to claim 6, wherein an outer wall of the bottom cover is concavely provided with an annular groove, at least one controlling key electrically connected with the controlling module is located inside the annular groove.

8. The cup according to claim 1, wherein a top surface of the top cover has a handle, the handle comprises a buckling part and an mounting part spaced with the buckling part, a pressing buckle is located between the mounting part and the buckling part.

9. The cup according to claim 8, wherein the buckling part has a torsional spring structure, one end of the pressing buckle is hinged with the mounting part, the other end of the pressing buckle resists with a bottom end of the buckling part closing to a side of the mounting part.

10. The cup according to claim 1, wherein a bottom of the cup body has a detachable base, the detachable base is made of wear-resistant material.

* * * * *